US010190737B2

(12) United States Patent
Li et al.

(10) Patent No.: US 10,190,737 B2
(45) Date of Patent: Jan. 29, 2019

(54) TROFFER LIGHT FIXTURE RETROFITTING KIT AND METHOD TO INSTALL THE SAME

(71) Applicant: Jiangmen POTOP Opto-Electronic Technology Co., Ltd., Jiangmen, Guangdong Province (CN)

(72) Inventors: Weida Li, Jianghai District (CN); Lawrence Rocklan E, Albuquerque, NM (US)

(73) Assignee: Jiangmen POTOP Opto-Electronic Technology Co., Ltd., Jiangmen (CN)

( * ) Notice: Subject to any disclaimer, the term of this patent is extended or adjusted under 35 U.S.C. 154(b) by 32 days.

(21) Appl. No.: 15/407,801

(22) Filed: Jan. 17, 2017

(65) Prior Publication Data

US 2018/0010746 A1 Jan. 11, 2018

(30) Foreign Application Priority Data

Jul. 6, 2016 (CN) ..... 2016 1 0533453
Jul. 6, 2016 (CN) ..... 2016 2 0714821 U

(51) Int. Cl.
*F21S 8/02* (2006.01)
*F21V 17/10* (2006.01)
*F21Y 115/10* (2016.01)

(52) U.S. Cl.
CPC ..... *F21S 8/026* (2013.01); *F21V 17/10* (2013.01); *F21Y 2115/10* (2016.08)

(58) Field of Classification Search
CPC ..... F21S 8/026; F21V 17/10; F21Y 2115/10
USPC ..... 362/217.11
See application file for complete search history.

(56) References Cited

U.S. PATENT DOCUMENTS

2007/0211457 A1* 9/2007 Mayfield, III ..... F21S 8/02 362/223
2016/0069522 A1* 3/2016 Rao ..... F21K 9/27 362/219
2016/0102825 A1* 4/2016 Scribante ..... F21S 8/022 362/217.12

* cited by examiner

*Primary Examiner* — Anh T Mai
*Assistant Examiner* — Meghan K Ulanday
(74) *Attorney, Agent, or Firm* — Hauptman Ham, LLP

(57) ABSTRACT

A retrofit kit for a lay-in troffer LED luminaire comprising two sets of connecting beams, with a first set being arranged in a parallel orientation and a second set of connecting beams oriented in a perpendicular manner with respect to each of the first set of beams. Each set of connecting beams are engaged to connected to each other by means of multiple coupling retainers and clamping hooks matched with each other to form a quadrangular bracket capable of containing the troffer. Compressible and extendable fastening means are further placed at the lateral sides of the troffer. And the troffer is connected to the ceiling through the allocation with the bracket by making fastening means aligned with the connecting holes on the first or the second sets of connecting beams that receive the fastening means.

11 Claims, 9 Drawing Sheets

TROFFER LIGHT FIXTURE RETROFITTING KIT AND METHOD TO INSTALL THE SAME

CROSS-REFERENCE TO RELATED APPLICATIONS

None

STATEMENT REGARDING FEDERALLY SPONSORED RESEARCH AND DEVELOPMENT

Not applicable

THE NAMES OF THE PARTIES TO A JOINT RESEARCH AGREEMENT

Not applicable

INCORPORATION-BY-REFERENCE OF MATERIAL SUBMITTED ON A COMPACT DISC

Not applicable

BACKGROUND OF THE INVENTION

Field of the Invention

The present invention relates generally to light fixtures, more particularly to troffer luminaires, and still more particularly to a retrofit kit capable of being used to repair, assemble, disassemble and replace the troffer component of a lay-in ceiling troffer luminaire.

Description of the Related Art Including Information Disclosed Under 37 CFR 1.97

The following description of the art related to the present invention refers to a number of references including publications and patents. Discussion of such references herein is given to provide a more complete background of the principles related to the present invention and is not to be construed as an admission that such references are necessarily prior art for patentability determination purposes.

A troffer light fixture is a quadrangular (square or rectangular) assembly generally comprising a housing (commonly known as tray) and a light source(s). Troffers are commonly installed in dropped ceiling systems, engineered ceilings, and other grid-type ceiling assemblies and are used both in the residential and commercial context. The housing typically comprises multiple walls; one top wall and four side walls and an opening. The housing also comprises mounted lamp sockets and electrical power receiving means (ballasts).

A typical troffer also comprises opening means engaged to the housing, the opening means further comprising a lens and being capable of opening toward the outside so as to facilitate the exchange of light sources.

Because of the popularity and shear number of troffer light fixtures already installed in millions of buildings, a system to retrofit existing troffers is highly desirable. In fact, many of the already-installed troffers are very difficult to retrofit and the prior art is scarce in terms of newly developed troffer systems that allow for quick, inexpensive and practical retrofitting.

U.S. Pat. No. 9,206,948 to Scribante, et al. (the "'948 patent"), discloses and claims a kit for retrofitting existing troffer light fixtures comprising a troffer housing. The '948 patent discloses a kit comprising an adaptor, bracket and door assembly. The kit disclosed and claimed in the '948 patent in effect comprises a connecting plate and a T-Shaped plate used to secure two sides of a lamp fixture, and a frame used to engage the connecting plate to the ceiling in such a way that a connecting plate is positioned via the T-shaped plate which is placed in such a configuration that it abuts the ceiling. The lamp fixture is then secured in place using fastening means placed on the sides of the lamp fixture and attached to holes pre-cut on the connecting plate. The '948 patent's assembly is installed in such a way that a gap is generated between the T-shaped plate and the connecting plate. The gap increases in size gradually when retrofitting the light fixture.

The system of the '948 patent presents inherent structural and functional problems: if the gap is too big then the connector can easily disengage from the frame and will get bigger gradually with the replacements of a light emitting diode ("LED") retrofit kit. When the gap is excessively large, the connector can easily fall from the frame, thus creating a dangerous safety hazard which will result in the whole light fixture falling from the ceiling.

Troffer light fixtures are typically heavy. The weight of the troffer can place increasing structural stress on the fastening means of the '948 patent. That, combined with wear and tear, can result in the fastening means breaking and the fixture, or parts therein, disengaging from the ceiling. Therefore, the assembly, disassembly and retrofitting of troffer light fixtures in a safe, easy and expeditious manner is still a remaining problem in the light fixture industry.

The main objective of the invention embodied in the present application is to provide a retrofitting kit for a troffer light fixture that is easy to install, but that results in a secure, durable and strong assembly.

SUMMARY OF THE INVENTION

The troffer light fixture retrofitting kit embodied in the present application aims to solve the technical, practical and commercial problems set forth above by providing a retrofit kit for a lay-in troffer LED luminaire comprising two sets of connecting beams. The first set of connecting beams comprises two beams, arranged in a parallel orientation and each connecting beam further comprising a long wall, a short wall, each wall being perpendicular from the other, and at least one elongated edge depending from the short wall, pointing away from and parallel to the long wall. The second set of connecting beams also comprises two beams, arranged in a parallel orientation and each connecting beam further comprising a long wall, a short wall, each wall being perpendicular from the other, and at least one elongated edge depending from the short wall, pointing away from and parallel to the long wall, with each beam being oriented in a perpendicular manner with respect to each of the first set of beams. The frame of the ceiling comprises at least one supporting plate for supporting the elongated edges of the connecting beams, for example, the elongated edges of the first set of connecting beams and/or the elongated edges of the second set of connecting beams, wherein the first set of connecting beams and the second set of connecting beams are arranged around a light fixture. Each set of connecting beams are engaged to connected to each other by means of multiple coupling retainers and clamping hooks matched to form a quadrangular (rectangular or square) bracket capable of containing the troffer or refers to light fixture the present application describes and claims.

The preferred embodiment of the invention further comprises:

(a) a supporting plate of the frame that receives at least three sides of the elongated edges;

(b) at least one compressible and extendable fastening means placed at a lateral side of the troffer or refers to light fixture, wherein accordingly each beam of the first set or second set of connecting beams further comprises at least one connecting hole that receives the fastening means through it;

(c) at least one connecting holes being capsule-shaped and being located on either side of the beams of the first set of connecting beams or the second set of connecting beams;

(d) a bar and a fixing base both being part of the fastening means and being engaged to the troffer or refers to light fixture, wherein;

(i) the fixing base comprises a guiding portion;

(ii) the guiding portion further comprises a first guiding hole for receiving and allowing the bar to slide;

(iii) the fixing base comprises a first retaining portion arranged along the sliding direction of the bar, with a springing means being arranged between the bar and the second retaining portion; and (iv) the bar comprises a first protrusion with a radial area being smaller than the bar and pointing toward the connecting hole and the connecting hole having a radial area which dimension falls between the radial areas of the first protrusion and the bar; wherein the bar further comprises a second protrusion with a radial area being smaller than the bar at its end toward the second retaining portion which comprises a second guide hole for receiving the second protrusion, or the retaining portion is provided with a second protrusion with a radial area less than the bar and the bar is provided with a blind hole arranged at its end towards the retaining portion for receiving the second protrusion;

(e) a bracket comprising the first and second connecting beams and a lateral plate/beam arranged between the connecting hole and the fastening means, and a middle hole on the lateral plate/beam capable of receiving the first protrusion, the middle hole having a radial area between the radial areas of the first protrusion and the bar; and (f) a springing means comprising a spring encasing the second protrusion.

When compared with the prior art, the invention embodied in the present application presents several distinct advantages. For example, the first connecting beams is supported by the frame of the ceiling. One of the second connecting beams is then engaged to one the first connecting beams with the body being detachably fixed to one of the first connecting beams or to one of the second connecting beams through one of the fastening means. That structure results in a quadrangular body that encloses the rest of the components thus making the retrofitting kit safe and quick to assemble and disassemble and very convenient to replace.

BRIEF DESCRIPTION OF DRAWINGS

The embodiments of the present invention will be further described in detail hereinafter with reference to the drawings, wherein.

DETAILED DESCRIPTION OF THE EMBODIMENTS

Objects, advantages and novel features, and further scope of applicability of the present invention will be set forth in part in the detailed description to follow, taken in conjunction with the accompanying drawings. The objects, advantages and novel features, and further scope of applicability of the present invention will become apparent to those skilled in the art upon examination of the following, or may be learned by practice of the invention. The objects and advantages of the invention may be realized and attained by means of the instrumentalities and combinations particularly pointed out in the appended claims.

Specifically, the detailed description below refers to left and right sides, as well as front and back sides, of the body having a rectangular cross section. The names and orientation of those elements are being used to enable persons familiar with the art to which this invention pertains to more clearly understand the technical solutions the present invention provides. It should be noted that any technical solutions offered in the descriptions herein are not intended to constitute a departure from the scope and spirit of the present invention. Instead, they are supposed to illustrate the most efficient manner to mutually replace the frame's left and right sides. The change of the front and back sides are illustrated by changing the viewing angle.

The following description of the preferred embodiment of the invention is provided given to illustrate the overall structure of the troffer luminaire LED retrofit kit of this invention.

Figure 9:
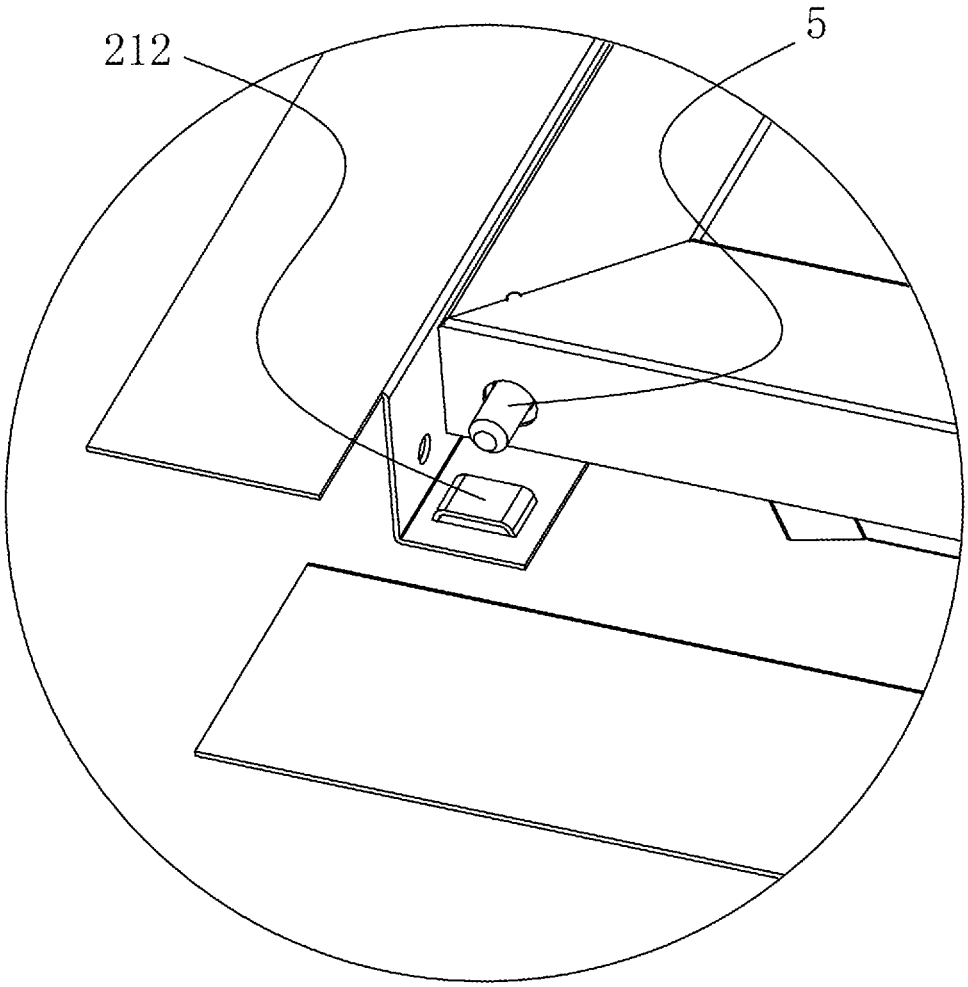
FIG. 9 is a schematic view of a coupling retainer.

In a first preferred embodiment, as shown in FIGS. 1*a* and 1*b* and FIG. 2 to FIG. 4, the troffer retrofit comprises a body 1, the body further comprising a rectangular cross section, a bracket 2, the bracket 2 being placed at one of the sides of the body 1, the bracket being capable of encasing the body 1. The bracket 2 comprises a second set of connecting beams 22 arranged at left and right sides of the lamp body 1 and a first set of connecting beams 21 arranged at front and back sides of the lamp body 1. Each beam of the first set of connecting beams 21 comprises an elongated edge 211, an existing frame 3 connected to the ceiling can be provided with a supporting plate 31 for supporting the elongated edge 211. Each beam of the first set of connecting beams 21 also comprises a coupling retainer 212 as shown in FIG. 9, and each beam of the second set of connecting beams 22 comprises a clamping hook 221 capable of removably engaging the coupling retainer 212. All four corners of the lamp body 1 comprise each one compressible and extendable fastening means 5. Each beam of the second set of connecting beams 22 further comprises two connecting holes 4 capable of receiving fastening means 5 through them.

The method to install the troffer retrofitting kit of the present invention comprises the following steps:

1. Arranging the elongated edge 211 of each of the first set of connecting beams 21 immediately above the supporting plate 31, thus enabling the frame 3 to support each of the beams of the first set of connecting beams 21;

2. Buckling the clamping hook 221 on each of the beams of the second set connecting beams 22 in the coupling retainer 212, so that the beam of the first set of connecting beams 21 is matched with each of the beams of the second set of connecting beams 22 to form the rectangular bracket 2;

3. Compressing the fastening means 5 and placing the body 1 in the bracket 2 so that when the fastening means 5 aligns with the connecting hole 4, the two fastening means 5 at one end of each beam of the second set of connecting beams 22 may be loosen first and buckled on the bracket 2, connecting the wires, and the two remaining fastening means 5 at the opposite end of each beam of the second set of connecting beams are compressed and then released through the bracket 2 to complete encasing of the body 1, bracket 2 and frame 3; and 4. Providing electricity to the body 1 through wiring.

Figure 1A:
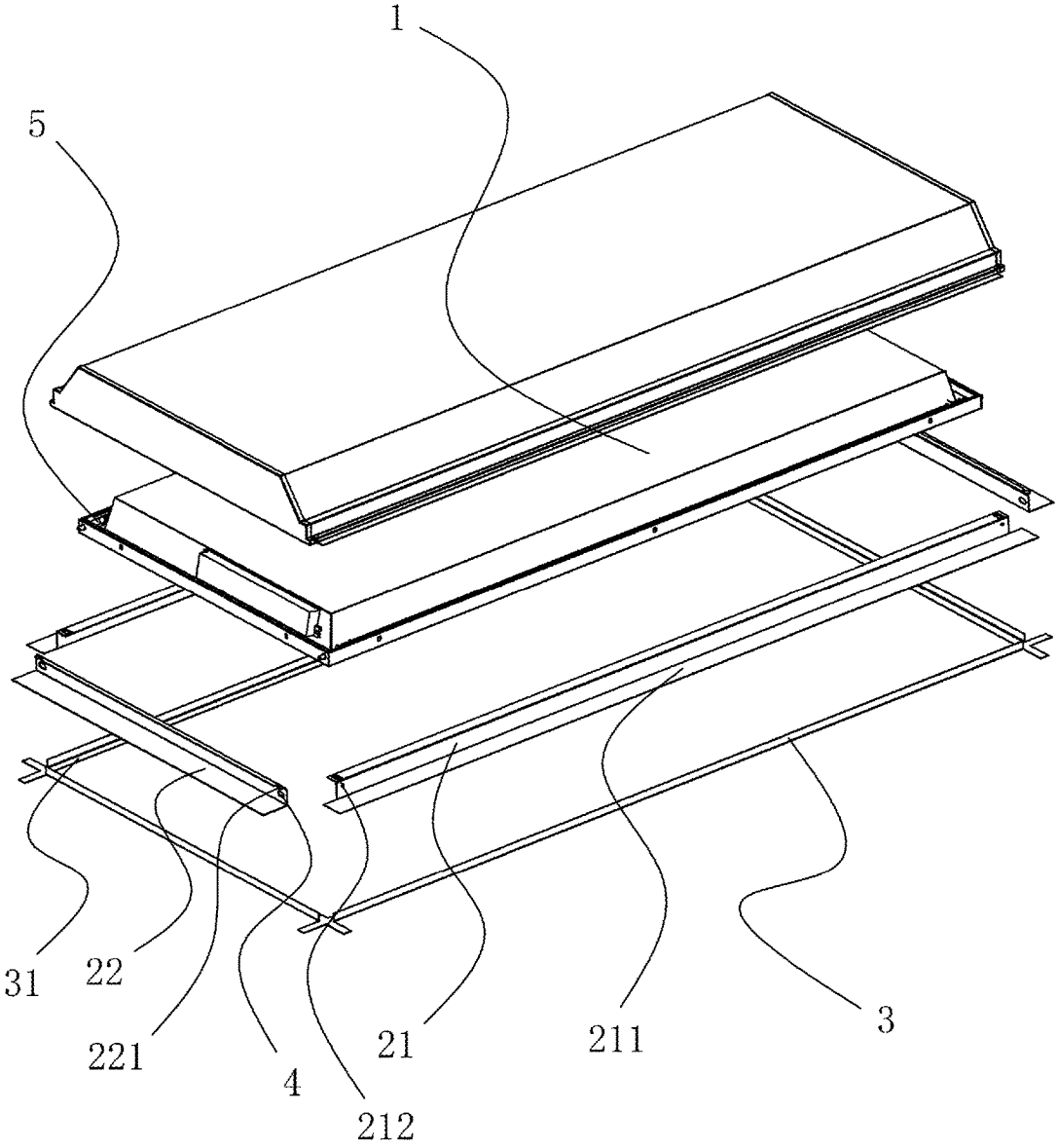
FIG. 1*a* is an exploded view of a novel troffer retrofit having a connecting hole in a second connecting beam.
Figure 1B:
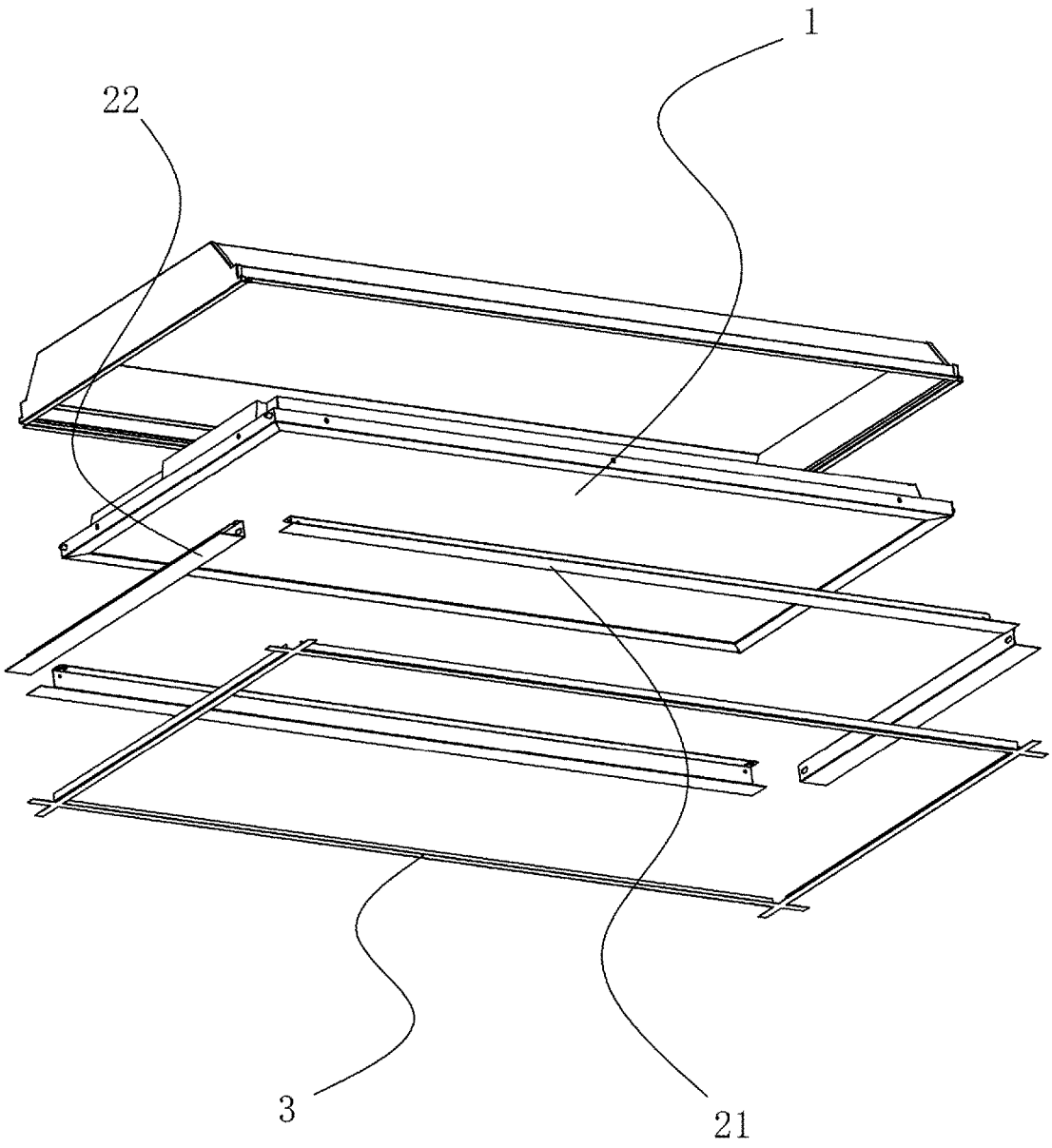
FIG. 1*b* is another exploded view of the novel troffer retrofit having a connecting hole in a second connecting beam.
Figure 2:
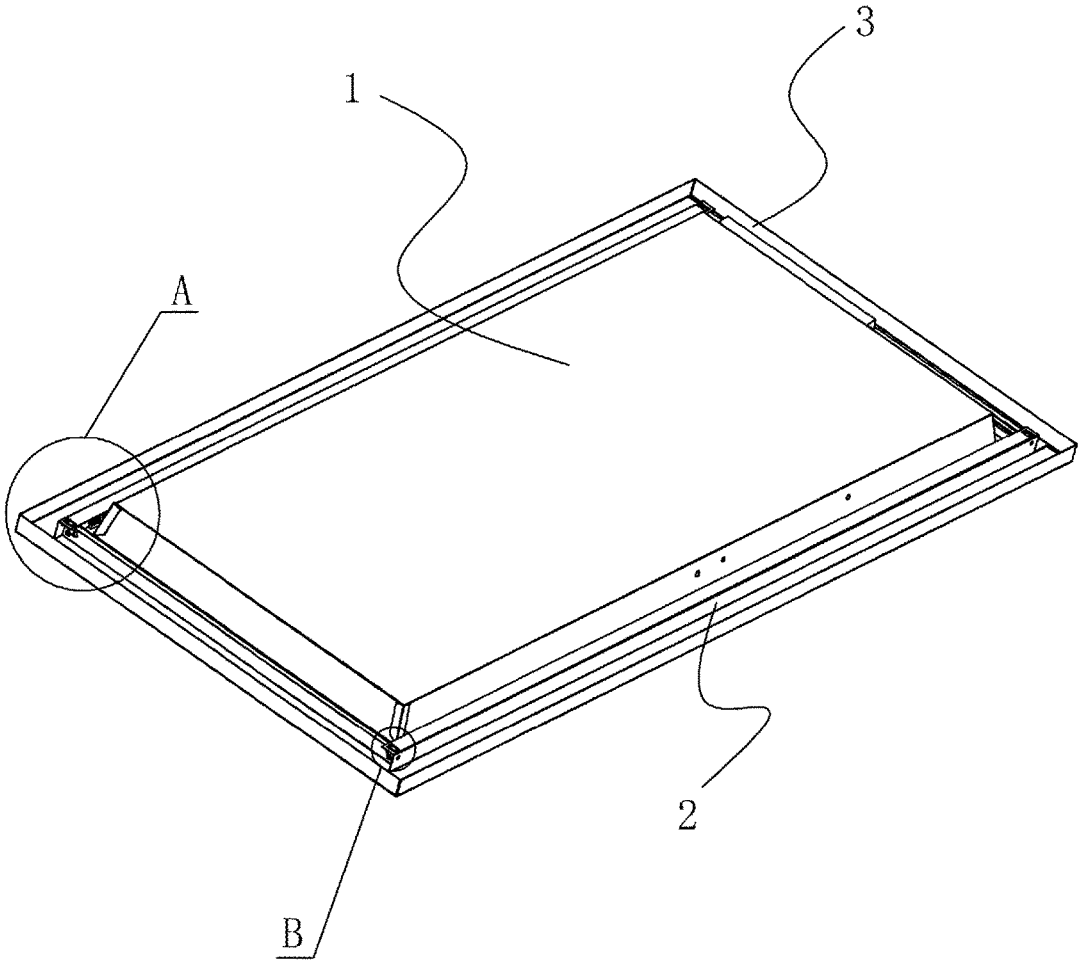
FIG. 2 is an overall schematic view of the troffer retrofit in FIGS. 1*a* and *b;*
Figure 3:
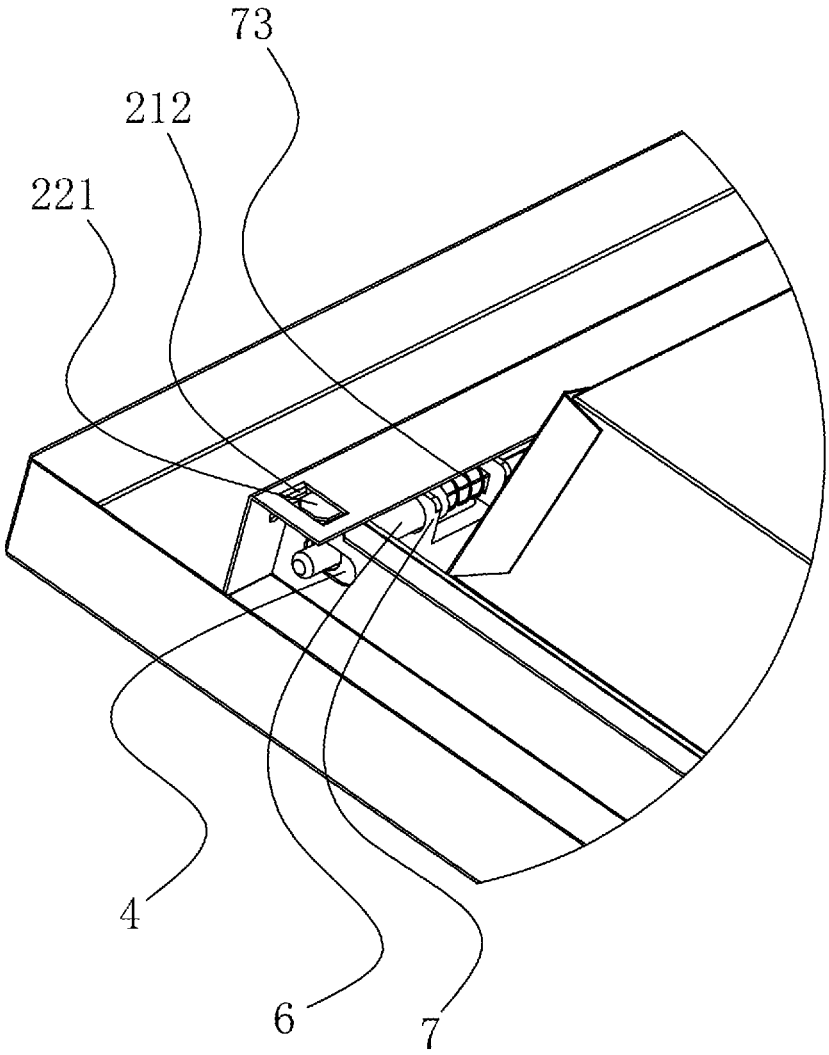
FIG. 3 is a partially enlarged view of part A in FIG. 2.
Figure 4:
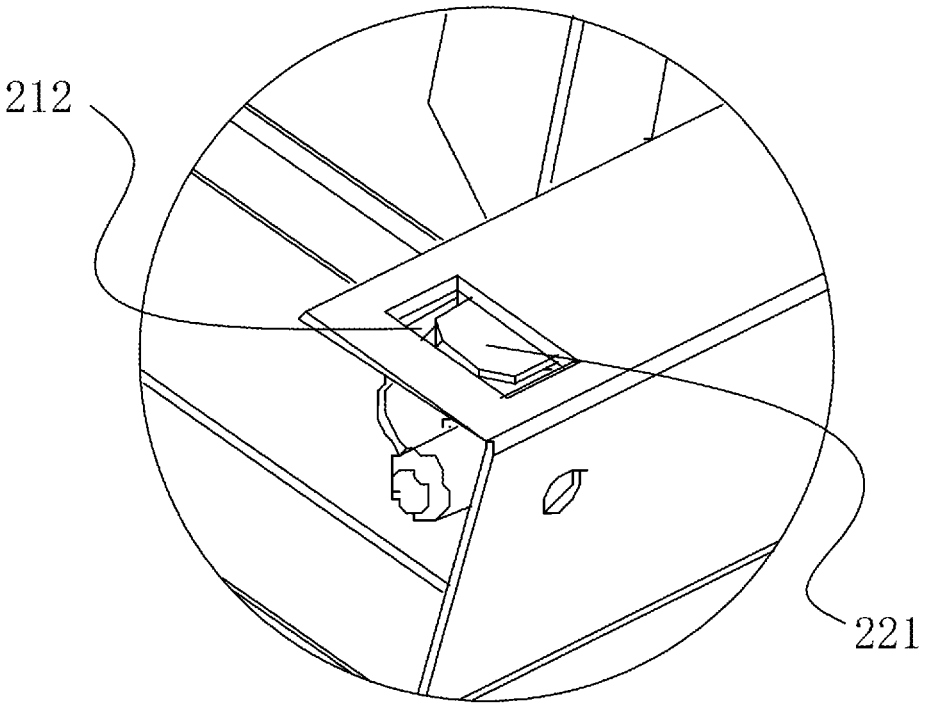
FIG. 4 is a partially enlarged view of part B in FIG. 2.
Figure 5:
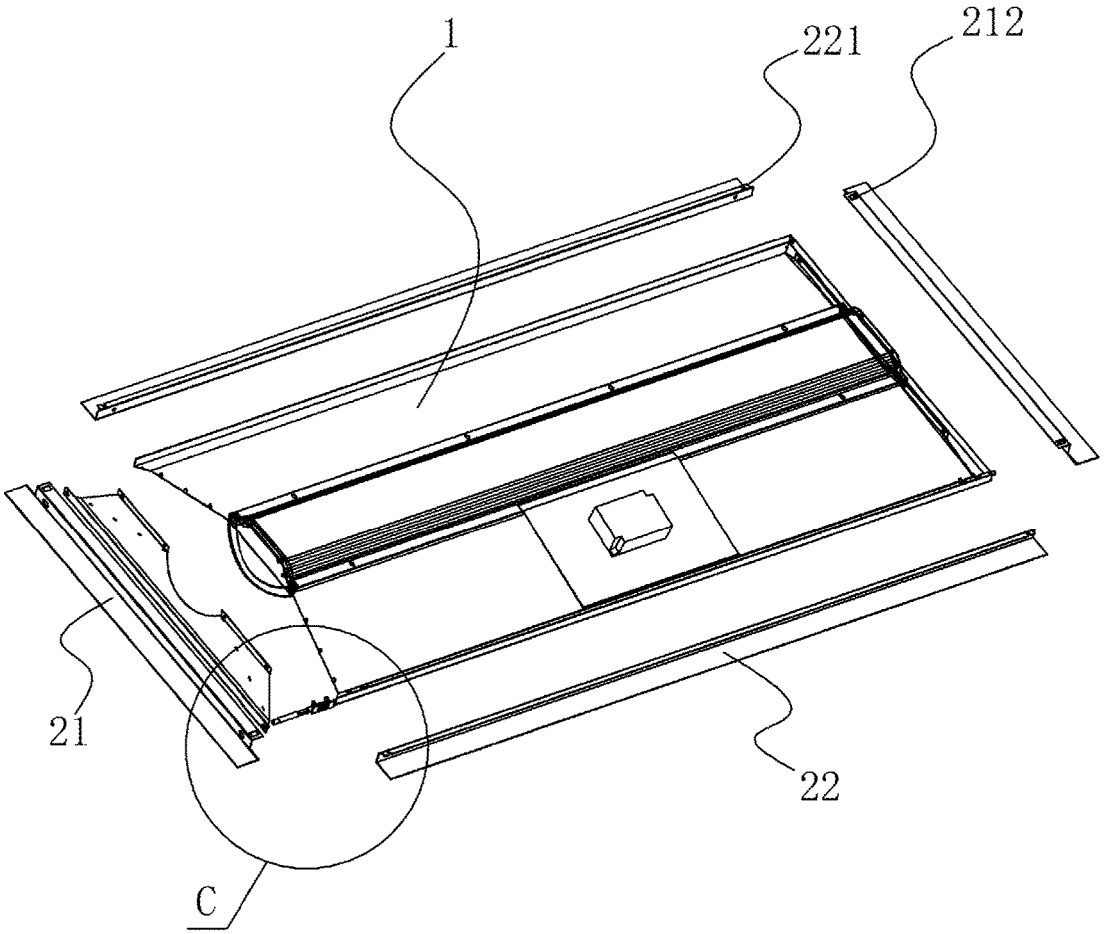
FIG. 5 is an exploded view of a novel troffer retrofit having a connecting hole in a first connecting beam.
Figure 6:
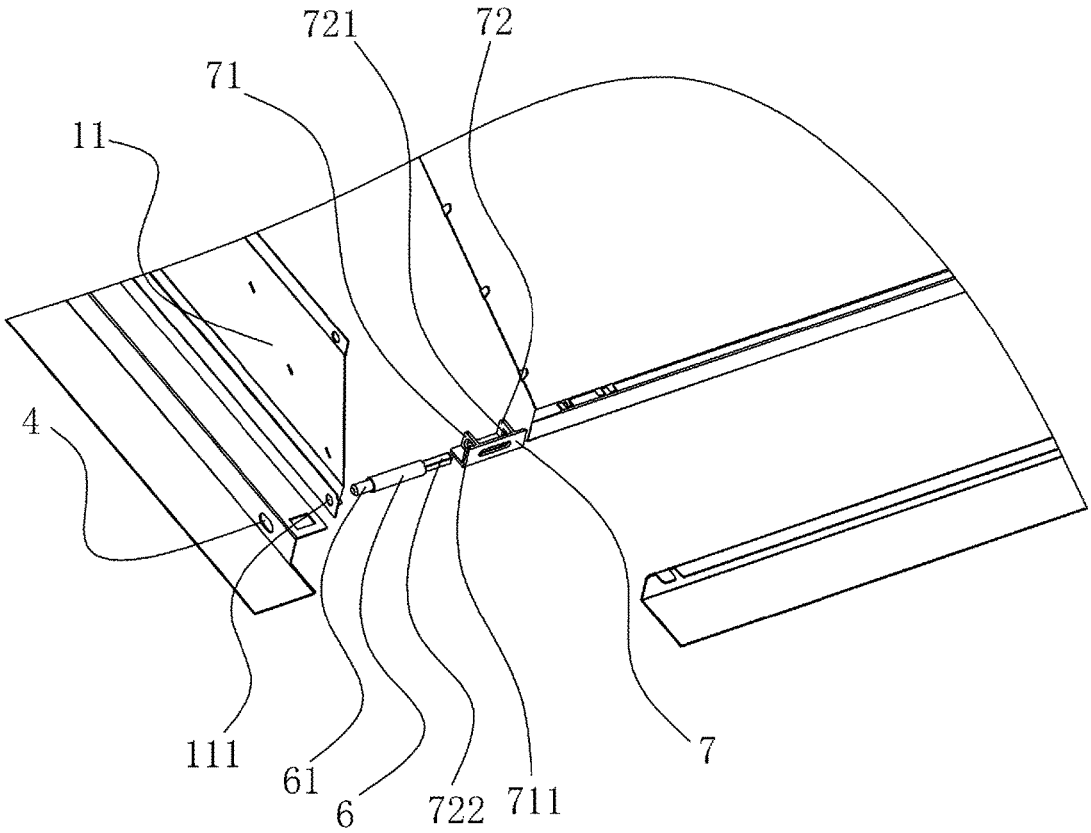
FIG. 6 is a partially enlarged view of part C in FIG. 5.

In a second embodiment of the retrofitting kit of the present invention, as shown in FIG. 5 and FIG. 6, the retrofit comprises a body 1 comprising a rectangular cross section, a bracket 2 placed at one of the sides of the body 1, the bracket being capable of encasing the body 1. All the other elements of that embodiment are the same as the preferred embodiment, except that the fastening means 5 passes through the connecting hole 4 on the first connecting beams 21, instead of passing through the connecting hole of the second connecting beams 22.

In both the preferred embodiment and the second embodiment of the present invention, the frame 3 comprises a supporting plate 31 capable of supporting at least the three of the four sides of the elongated edge 211, excluding the side of the elongated edge 211 that points toward the body 1. Such structure is intended to secure the first connecting beams 21 in the frame 3 in a seamless and stable manner both in a transverse and longitudinal directions.

Alternatively, in both the preferred embodiment and the second embodiment of the present invention, the frame 3 comprises a supporting plate 31 capable of supporting the elongated edge 211. Such structure is intended to secure the first connecting beams 21 against the second connecting beams 22 in the frame 3 in a seamless and stable manner both in a transverse and longitudinal directions.

In yet a third alternative embodiment of the present invention as shown in FIG. 5 and FIG. 6, the fastening means 5 comprises a bar 6 and a fixing base 7 connected to the body 1. The fixing base 7 comprises a guide portion 71 that is internally provided with a first guide hole 711 for the bar 6 to slide through. The fixing base 7 further comprises a retaining portion 72 arranged along the sliding direction of the bar 6. A springing means 73 is arranged between the bar 6 and the retaining portion 72. The bar 6 comprises a first protrusion 61 having a radial area less than the bar 6 and oriented towards the connecting hole 4, the body 1 may further comprise a lateral plate 11 arranged between the connecting hole 4 and the fastening means 5, a middle hole 111 capable of preventing the first protrusion 61 to pass through is arranged in the lateral plate 11, and a radial area of the middle hole 111 is between radial areas of the first protrusion 61 and the bar 6. The arrangement of the lateral plate 11 and the middle hole 111 prevents the bar 6 from moving outside of the light body 1.

In a fourth alternative embodiment of the invention, the fastening means 5 comprises a bar 6 and a fixing base 7 connected to the body 1. The fixing base 7 comprises a guide portion 71 that in turn comprises a first guide hole 711 for the bar 6 to slide through. The fixing base 7 further comprises a retaining portion 72 arranged along the slide direction of the bar 6, and a springing means 73 is arranged between the bar 6 and the retaining portion 72. The bar 6 is provided with a first protrusion 61 having a radial area less than the bar 6 towards the connecting hole 4, and a radial area of the connecting hole 4 is between radial areas of the first protrusion 61 and the bar 6. The limitation of the radial area of the connecting hole 4 enables the bar 6 to not move outside of the bracket 2.

Both the third and fourth alternative embodiments of the present invention further comprise the following variations that then constitute fifth and sixth alternative embodiments of the invention.

Figure 7:
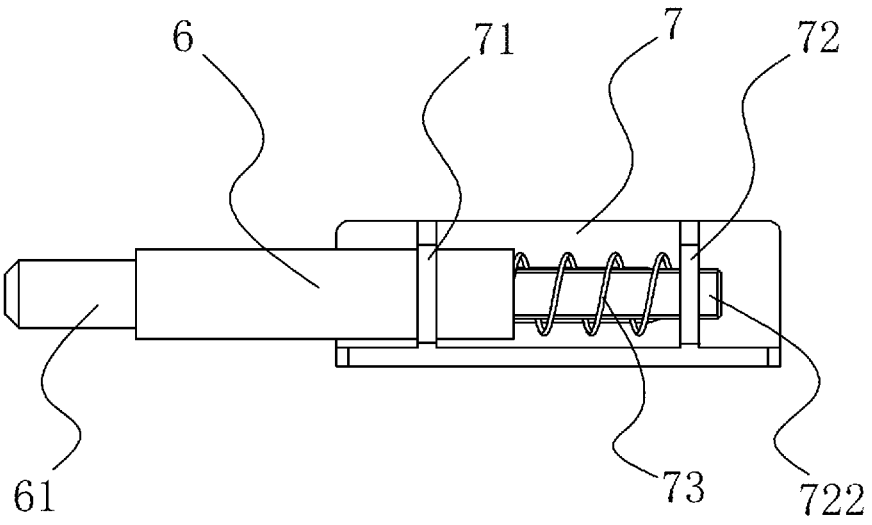
FIG. 7 is a schematic view of a fastening means in an embodiment.

In a fifth alternative embodiment of the invention, as shown in FIG. 7, the end of the bar 6 oriented towards the retaining portion 72 comprises a second protrusion 722 having a radial area smaller than the bar 6. The springing means 73 is sheathed outside the second protrusion 722, and the retaining portion 72 comprises a second guiding hole 721 that allows the second protrusion 722 to pass through it.

Figure 8:
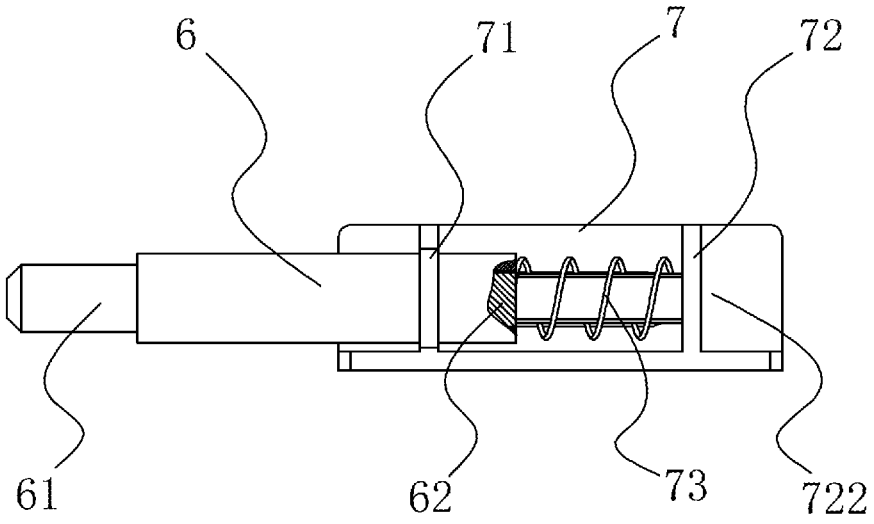
FIG. 8 is a schematic view of a fastening means in an alternative embodiment.

In a sixth alternative embodiment of the invention, as shown in FIG. 8, the retaining portion 72 comprises a second protrusion 722 having a radial area smaller than the bar 6. The springing means 73 is sheathed outside the second protrusion 722, and the end of the bar 6 oriented towards the retaining portion 72 comprises a blind hole 62 for receiving the second protrusion 722.

The above embodiments are for purposes of illustration and description to the technical solutions of the present invention merely, but are not intended to limit the present invention. Any modification or equivalent replacement without departing from the spirit and scope of the present invention shall all fall within the scope of the technical solutions of the present invention.

The invention claimed is:

1. A retrofit kit for a lay-in troffer LED luminaire comprising:

a first and a second set of connecting beams, the first set of connecting beams comprising two beams arranged in a parallel orientation, each beam of the first set of connecting beams further comprising a long wall, a short wall, each wall being perpendicular from the other, and at least one elongated edge depending from the short wall, pointing away from, and parallel to, the long wall;

the second set of connecting beams also comprising two beams, arranged in a parallel orientation and each connecting beam further comprising a long wall, a short wall, each wall being perpendicular from the other, and at least one elongated edge depending from the short wall, pointing away from, and parallel to, the long wall, each beam of the second set of connecting beams being oriented in a perpendicular manner with respect to each of the first set of connecting beams;

multiple engaging means consisting of coupling retainers and clamping hooks that engage each set of connecting beams to each other to form a quadrangular bracket capable of containing the troffer, wherein at least the elongated edges of the first set of connecting beams are supported by supporting plates of a frame engaging to a ceiling;

a body, and compressible and extendable fastening means placed at the lateral sides of the troffer, wherein the first or second set of connecting beams further comprise connecting holes near four corners of the troffer, the fastening means are compressed and loosen into the connecting holes when the fastening means align with the holes to make the troffer connect to the ceiling through the allocation with the bracket, wherein the fastening means comprises a bar and a fixing base which is connected to the body, the fixing base comprising a guide portion that comprises internal first guide hole for the bar to slide through, the fixing base further comprising a retaining portion arranged along the sliding direction of the bar, a springing means being arranged between the bar and the retaining portion, the bar further comprising a first protrusion having a radial area less than the bar and oriented towards the connecting hole.

2. The retrofit kit for a lay-in troffer LED luminaire of claim 1 wherein the body comprises a rectangular cross section, the bracket with the connecting beams placed at the sides of the body that encases the body, multiple connecting holes being capsule-shaped or round-shaped and being located on either one of the beams of the first or the second set of connecting beams, which receive the fastening means passing through.

3. The retrofit kit for a lay-in troffer LED luminaire of claim 1 wherein a supporting plate of the frame is capable of supporting at least the three of the four sides of the elongated edge, excluding the side of the elongated edge that points toward the body resulting in a structure that secures the connecting beams in the frame in a seamless and stable manner both in a transverse and longitudinal directions.

4. The retrofit kit for a lay-in troffer LED luminaire of claim 1 wherein the body further comprises:

a lateral plate arranged between the connecting hole and the fastening means; and a middle hole that allows the first protrusion to pass through, the middle hole being arranged in the lateral plate, and wherein a radial area of the middle hole is between radial areas of the first protrusion and the bar, the relative structural arrangement of the lateral plate and the middle hole preventing the bar from moving outside of the body.

5. The retrofit kit for a lay-in troffer LED luminaire of claim 1 wherein a radial area of the connecting hole measuring between radial areas of the first protrusion and the bar, resulting in a limitation of the radial area of the connecting hole that prevents the bar from moving outside of the bracket.

6. The retrofit kit for a lay-in troffer LED luminaire of claim 1 wherein an end of the bar oriented towards the retaining portion comprises a second protrusion having a radial area smaller than the bar, the springing means is sheathed outside the second protrusion, and the retaining portion comprises a second guiding hole that allows the second protrusion to pass through it.

7. The retrofit kit for a lay-in troffer LED luminaire of claim 6 wherein the springing means is a spring sheathed outside the second protrusion.

8. The retrofit kit for a lay-in troffer LED luminaire of claim 1 wherein the retaining portion comprises a second protrusion having a radial area smaller than the bar, the springing means is sheathed outside the second protrusion, and the end of the bar oriented towards the retaining portion comprises a blind hole for receiving the second protrusion.

9. A method to install a retrofit kit for a lay-in troffer LED luminaire according to claim 1 comprising the steps of:

arranging the elongated edge of each of the connecting beams immediately above the supporting plate of the frame, thus enabling the frame to support at least two of the connecting beams;

buckling the clamping hook on each of the beams of the connecting beams into the coupling retainer, so that the connecting beams matched with each other to form the rectangular bracket;

compressing the fastening means and placing the body in the bracket so that when the fastening means aligns with the connecting hole, the fastening means loosen; and allowing two fastening means at one end of each beam of the first set or second set of connecting beams to loosen first and buckle on the bracket, connecting the wires, and the two remaining fastening means at an opposite end of each beam of the first set or second set of connecting beams to become compressed and then released to complete the encasing of the body by the bracket.

10. The method of claim 9, further comprising:

providing electricity to the body through wiring.

11. A retrofit kit for a lay-in troffer LED luminaire comprising:

a first and a second set of connecting beams, the first set of connecting beams comprising two beams arranged in a parallel orientation, each beam of the first set of connecting beams further comprising a long wall and a short wall, each wall being perpendicular to the other, and at least one elongated edge depending from the short wall, pointing away from and parallel to, the long wall, the second set of connecting beams also comprising two beams arranged in a parallel orientation and each connecting beam further comprising a long wall and a short wall, each wall being perpendicular to the other, and at least one elongated edge depending from the short wall, pointing away from and parallel to, the long wall, each beam of the second set of connecting beams being oriented in a perpendicular manner with respect to each of the first set of connecting beams;

coupling retainers and clamping hooks configured to engage each set of connecting beams to each other to form a quadrangular bracket capable of containing the troffer, wherein at least the elongated edges of the first set of connecting beams are supported by supporting plates of a frame configured to engage to a ceiling;

a body; and compressible and extendable fasteners placed at the lateral sides of the troffer, wherein the first or second set of connecting beams further comprise connecting holes near four corners of the troffer, the fasteners are compressed and loosen into the connecting holes when the fasteners align with the holes to make the troffer connect to the ceiling through the allocation with the bracket, wherein the fasteners comprise a bar and a fixing base which is connected to the body, the fixing base comprising a guide portion that comprises internal first guide hole for the bar to slide through, the fixing base further comprising a retaining portion arranged along the sliding direction of the bar, a spring being arranged between the bar and the retaining portion, the bar further comprising a first protrusion having a radial area less than the bar and oriented towards the connecting hole.

* * * * *